US010734208B2

(12) United States Patent
Takeshita

(10) Patent No.: US 10,734,208 B2
(45) Date of Patent: Aug. 4, 2020

(54) IMAGING MASS SPECTROMETER

(71) Applicant: SHIMADZU CORPORATION, Kyoto-shi, Kyoto (JP)

(72) Inventor: Kengo Takeshita, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 42 days.

(21) Appl. No.: 16/300,243

(22) PCT Filed: May 10, 2016

(86) PCT No.: PCT/JP2016/063861
§ 371 (c)(1),
(2) Date: Mar. 1, 2019

(87) PCT Pub. No.: WO2017/195271
PCT Pub. Date: Nov. 16, 2017

(65) Prior Publication Data
US 2019/0221409 A1 Jul. 18, 2019

(51) Int. Cl.
*H01J 49/00* (2006.01)

(52) U.S. Cl.
CPC ..... *H01J 49/0004* (2013.01); *H01J 49/004* (2013.01); *H01J 49/0036* (2013.01)

(58) Field of Classification Search
CPC ..... H01J 49/00; H01J 49/02; H01J 49/0004; H01J 49/0027; H01J 49/027; H01J 49/0413; H01J 49/26
(Continued)

(56) References Cited

U.S. PATENT DOCUMENTS

2013/0277548 A1* 10/2013 Claude ..... H01J 49/0027 250/282
2016/0071711 A1 3/2016 Ikegami

FOREIGN PATENT DOCUMENTS

JP 2013-40808 A 2/2013
WO 2010/089611 A1 8/2010
WO 2014/175211 A1 10/2014

OTHER PUBLICATIONS

"iMScope TRIO Imeejingu Shitsuryou Kenbikyou (iMScope TRIO—Imaging Mass Microscope)", [online], Shimadzu Corporation, 2 pages.

(Continued)

*Primary Examiner* — Jason L McCormack
(74) *Attorney, Agent, or Firm* — Sughrue Mion, PLLC

(57) ABSTRACT

An $MS^2$ analysis for one precursor ion is performed to collect data on each micro area within a measurement target area (S1). A plurality of product ions are extracted based on those data (S2), and a mass spectrometric (MS) imaging graphic is created for each m/z of the product ion (S3). Hierarchical cluster analysis is performed on the created MS imaging graphics to group the product ions based on the similarity of the graphics (S4). Product ions having similar distributions are sorted into the same group. Such a group of ions can be considered to have originated from the same compound. Accordingly, the intensity information of a plurality of product ions is totaled in each group and for each micro area (S5), and an MS imaging graphic is created based on the totaled intensity information (S6). Even if there are a plurality of compounds overlapping the precursor ion, the influence of the overlapping can be eliminated through those steps. Thus, a graphic having a higher level of SN ratio, sensitivity and dynamic range than an MS imaging graphic obtained at a single product ion can be created and displayed.

5 Claims, 4 Drawing Sheets

(58) Field of Classification Search
USPC ..... 250/281, 282
See application file for complete search history.

(56) References Cited

OTHER PUBLICATIONS

Written Opinion of the International Searching Authority of PCT/JP2016/063861 dated Jul. 19, 2016.
International Search Report of PCT/JP2016/063861 dated Jul. 19, 2016.
Communication dated Mar. 26, 2019 from the European Patent Office in application No. 16901620.1.

* cited by examiner

TOTALING THE INTENSITY INFORMATION AT M1, M2, M4, ... FOR EACH MICRO AREA
TOTALING THE INTENSITY INFORMATION AT M3, M5, ... FOR EACH MICRO AREA

M1
M2
M4
M3
M5
GROUPING BY HCA

M1
M2
M3
M4
M5
Mn
MS IMAGING GRAPHIC AT EACH m/z
PEAK (m/z) EXTRACTION

Int.
m/z
122
121
12 y
x

IMAGING MASS SPECTROMETER

CROSS REFERENCE TO RELATED APPLICATIONS

This application is a National Stage of International Application No. PCT/JP2016/063861 filed May 10, 2016.

TECHNICAL FIELD

The present invention relates to an imaging mass spectrometer for performing a mass spectrometric analysis on each of a large number of measurement points within a two-dimensional area on a sample and for creating a graphic (or image) which reflects the distribution of a substance, surface condition of the sample, etc., within the two-dimensional area, based on the information obtained by the analysis.

BACKGROUND ART

Mass spectrometric imaging is a technique for investigating the distribution of a substance having a specific mass by performing a mass spectrometric analysis at each of a plurality of measurement points (micro areas) within a two-dimensional area on a sample, such as a biological tissue section. This technique has been increasingly applied in various areas, such as the drug discovery, biomarker search, and identification of the causes of diseases. Mass spectrometers for carrying out mass spectrometric imaging are generally called "imaging mass spectrometers" (see Non-Patent Literature 1, Patent Literature 1 or other documents). They may also be called "microscopic mass spectrometers" or "mass microscopes", since an analysis using those devices typically includes the steps of microscopically observing a desired two-dimensional area on a sample, setting a measurement target area based on the microscopic observation image, and performing an imaging mass spectrometric analysis on that area. In the present description, the term "imaging mass spectrometer" is used.

An imaging mass spectrometer normally employs an ionization method in which a sample is placed on a sample stage and irradiated with a laser light, electron beam, stream of gas containing charge droplets, plasma gas, etc., to ionize substances (compounds) contained in the sample. Mass spectrometry employing such an ionization method does not require separating the components by a liquid chromatograph (LC), gas chromatograph (GC) or other devices. However, it is often the case that a large number of compounds are simultaneously detected, particularly when the analysis is performed on a biological sample or the like. In such a case, a peak on a mass spectrum which appears to be a single peak may actually be a plurality of peaks derived from multiple compounds and overlapping each other. If a mass spectrometric imaging graphic is created at a mass-to-charge ratio corresponding to such a peak formed by a plurality of compounds overlapping each other, the compound distribution information cannot be accurately obtained, since the signal intensity at each pixel on the mass spectrometric imaging graphic is the sum of the signal intensities which respectively correspond to those compounds.

The rapid technical advancement in mass spectrometers in recent years has led to a dramatic improvement in their mass-resolving power. If such a high-resolution imaging mass spectrometer is used, it is possible to obtain a mass spectrometric imaging graphic which is unaffected by other compounds having close mass-to-charge ratios. However, the improvement in mass-resolving power has also been accompanied by an increase in size and price of the device as well as an increase in the measurement time. In some cases, those restrictions may obstruct the use of a device with high mass-resolving power. There is also the limitation that even a device with the maximally improved mass-resolving power cannot separate different compounds whose mass-to-charge ratios are exactly the same.

One method for solving such a problem is to create a mass spectrometric imaging graphic based on the result of an $MS^n$ analysis with n being equal to or greater than two. The imaging mass spectrometer described in Patent Literature 1, Non-Patent Literature 1 or other documents is equipped with an ion trap capable of capturing ions. Such a device can select a specific ion as the precursor ion from various ions of sample origin within the ion trap, and dissociate the selected precursor ion by collision induced dissociation (CID). Accordingly, in the case where a mass spectrometric imaging graphic for a target compound needs to be acquired, an $MS^2$ analysis in which the mass-to-charge ratio of an ion originating from the target compound is selected as the precursor ion is performed at each measurement point, and a mass spectrometric imaging graphic is created using intensity information at the mass-to-charge ratio of a product ion originating from the target compound. Even if there is another compound from which a precursor ion having the same mass-to-charge ratio is generated, its product ion normally has a different mass-to-charge ratio. Therefore, by using the intensity information of the product ion, it is possible to obtain a mass spectrometric imaging graphic which is unaffected by other compounds.

However, the amount of one product ion obtained in the $MS^n$ analysis is smaller than that of the original precursor ion, since the precursor ion is partially removed in the process of selecting the precursor ion, and since multiple kinds of product ions are normally generated from the precursor ion by the ion-dissociating operation. Accordingly, if the amount of compound to be observed is originally small, the signal intensity of the product ion may become extremely low. In such a case, it may be impossible to satisfactorily recognize the distribution of the target compound on the mass spectrometric imaging graphic created using the product ion.

CITATION LIST

Patent Literature

Patent Literature 1: WO 2014/175211 A

Non Patent Literature

Non-Patent Literature 1: "iMScope TRIO Imeejingu shisuryou Kenbikyou (iMScope TRIO Imaging Mass Microscope", [online], Shimadzu Corporation, [accessed on Apr. 11, 2016], the Internet

SUMMARY OF INVENTION

Technical Problem

The present invention has been developed to solve the previously described problem. Its objective is to provide an imaging mass spectrometer capable of creating a high-quality mass spectrometric imaging graphic while excluding an influence of other compounds which are present at the same measurement point.

Solution to Problem

The present invention developed for solving the previously described problem is an imaging mass spectrometer for creating a graphic reflecting the distribution of a substance within a two-dimensional area on a sample, based on data collected by performing an $MS^n$ analysis on each of a plurality of micro areas set within the two-dimensional area (where n is an integer equal to or greater than two), the imaging mass spectrometer including:

a) a distribution similarity determiner for determining the similarity in two-dimensional intensity distribution of a plurality of obtained product ions, based on data obtained by an $MS^n$ analysis for the same precursor ion on each micro area, and for grouping together product ions having a high degree of similarity in two-dimensional intensity distribution;

b) an intensity information calculator for totaling or averaging, for each micro area, intensity information of a plurality of product ions sorted into one group by the distribution similarity determiner, to calculate intensity information due to the plurality of product ions in each micro area; and c) a graphic creator for creating a mass spectrometric imaging graphic based on the intensity information due to the plurality of product ions in each micro area obtained by the intensity information calculator.

In the imaging mass spectrometer according to the present invention, the mass spectrometer is a mass spectrometer capable of an $MS^n$ analysis, such as an ion trap mass spectrometer, ion trap time-of-flight mass spectrometer, tandem quadrupole mass spectrometer, or Q-TOF mass spectrometer. The ion-dissociating technique for the $MS^n$ analysis is not specifically limited. For example, the collision induced dissociation, infrared multiphoton dissociation, electron capture dissociation, electron transfer dissociation, or any other technique may be used.

In the imaging mass spectrometer according to the present invention, for example, when there is a target compound for which the state of two-dimensional distribution of the concentration or content needs to be investigated, an $MS^2$ analysis in which an ion originating from that target compound (which is typically a molecular ion) is selected as the precursor ion is performed on each of the micro areas (measurement points) defined by dividing a two-dimensional measurement target area into a grid-like form, and a set of $MS^2$ spectrum data is collected for each micro area. Many kinds of product ions having different mass-to-charge ratios are normally generated by an ion-dissociating operation for one kind of precursor ion. Accordingly, based on the $MS^2$ spectrum data obtained for each micro area, the distribution similarity determiner determines the two-dimensional intensity distribution (spatial intensity distribution) for each of the product ions (to be exact, for each of the mass-to-charge ratios of the product ions). In the case of a conventional imaging mass spectrometer which utilizes an $MS^2$ analysis, what is eventually displayed is a single heat-map image created from such a two-dimensional intensity distribution.

By comparison, in the imaging mass spectrometer according to the present invention, the distribution similarity determiner determines the similarity in two-dimensional intensity distribution of the plurality of obtained product ions. The technique for determining the similarity in two-dimensional intensity distribution is not specifically limited. A preferable example is the hierarchical cluster analysis (HCA), which is a technique for statistical analysis. The clustering by HCA is a supervised clustering. An unsupervised clustering may also be used. The distribution similarity determiner groups together product ions which have a high degree of similarity in two-dimensional intensity distribution.

Suppose that the precursor ion entirely originates from a single compound (i.e. no foreign substance is present). In this case, all product ions exclusive of noise peaks originate from that single compound, and therefore, should show similar two-dimensional intensity distributions. Consequently, all product ions exclusive of the noise peaks will be sorted into a single group. By comparison, if the precursor ion originates from a plurality of compounds, the product ions will also be a mixture of ions originating from those compounds. Therefore, except when two or more compounds happen to have the same two-dimensional intensity distribution, the two-dimensional intensity distribution of the product ions will normally be different for each original compound (superposed on the single precursor ion). In this case, under ideal conditions, all product ions are sorted into the same number of groups as that of the original compounds.

Accordingly, for each micro area, the intensity information calculator totals or averages intensity information of a plurality of product ions sorted into one group, to calculate intensity information due to those ions in each micro area. If there are a plurality of groups, the calculation of the total or average of the intensity information of the product ions for each micro area may be performed for each of those groups. Alternatively, the calculation of the total or average of the intensity information of the product ions for each micro area may be only performed for one group which is of interest among those groups. For example, if the mass-to-charge ratio of a representative product ion originating from the target compound is previously known, the calculation of the intensity information due to the product ions in each micro area only needs to be performed for the group which includes that mass-to-charge ratio. In any case, if a plurality of kinds of product ions are included in one group, the accuracy of the intensity information can be improved by totaling or averaging the intensity information.

The graphic creator creates a mass spectrometric imaging graphic based on the intensity information due to the plurality of ions in each micro area obtained in the previously described manner. Thus, as compared to a conventional device, the present device can create a mass spectrometric imaging graphic based on the intensity information which is higher in accuracy or sensitivity. This graphic can be displayed, for example, on the screen of a display unit and presented to users.

The imaging mass spectrometer according to the present invention may be configured to allow users to previously set the mass-to-charge ratios of the product ions used for obtaining the two-dimensional intensity distributions whose similarity should be determined by the distribution similarity determiner. It is also possible to configure the device so as to determine the kinds of product ions by automatically detecting peaks appearing on a mass spectrum created from the collected $MS^n$ spectrum data.

That is to say, the imaging mass spectrometer according to the present invention may further include a product ion extractor for extracting the mass-to-charge ratio of a product ion based on data obtained by an $MS^n$ analysis for the same precursor ion in each micro area.

For example, the product ion extractor may collect all product-ion peaks detected on each $MS^n$ spectrum created for each micro area. It may otherwise create a mass spectrum in which the $MS^n$ spectra obtained in all micro areas are totaled for each mass-to-charge ratio, and collect product-ion peaks detected on that mass spectrum.

In the case where the mass-to-charge ratios of the product ions originating from a specific compound need to be extracted, the device may allow users to previously set those mass-to-charge ratios, as described earlier, or it may automatically select product ions based on a standard mass spectrum which will be obtained when an $MS^n$ analysis of the compound concerned is performed.

That is to say, in the imaging mass spectrometer according to the present invention, the product ion extractor may be configured to select a product ion with reference to a given standard mass spectrum.

Specifically, for example, a user specifies a target compound, whereupon a standard mass spectrum associated with that compound is read from a database or similar source. The product ion extractor selects only the product ions whose mass-to-charge ratios match with those of the peaks observed on the standard mass spectrum (or to be exact, whose mass-to-charge ratios fall within a predetermined range of mass-to-charge ratios centered on each peak) from among product ions extracted based on the $MS^n$ spectrum data obtained for each micro area. In other words, product ions which correspond to peaks that are not present on the standard mass spectrum are considered to be different from the product ions originating from the target compound, and are excluded from the target of the process of determining the similarity in two-dimensional intensity distribution. Thus, compounds other than the target compound are excluded, so that a mass spectrometric imaging graphic which accurately reflects the two-dimensional distribution of the target compound can be obtained.

As another possible example, a compound species in a certain sample may be inferred by a database search using an $MS^n$ spectrum obtained by a mass spectrometric analysis on the sample, and an $MS^n$ spectrum corresponding to the inferred compound species in the database may be designated as the standard mass spectrum to be referred to by the product ion extractor in selecting the product ions.

Advantageous Effects of Invention

In the imaging mass spectrometer according to the present invention, for example, even when there is a compound whose mass-to-charge ratio is the same as or extremely close to the mass-to-charge of the target compound (so that they cannot be separated by commonly used mass spectrometers), the influence of the former compound can be eliminated by data processing, and a high-quality mass spectrometric imaging graphic which accurately shows the two-dimensional distribution of the target compound can be created. Even when there are a plurality of compounds whose mass-to-charge ratios are identical or extremely close to each other, a high-quality mass spectrometric imaging graphic which accurately shows the two-dimensional distribution of the compound can be created for each of those compounds. Furthermore, when performing a measurement for creating a high-quality mass spectrometric imaging graphic, the imaging mass spectrometer according to the present invention does not require compounds having close mass-to-charge ratios to be separated from each other with a high mass-resolving power. Therefore, a comparatively inexpensive mass spectrometer can be used.

DESCRIPTION OF EMBODIMENTS

One embodiment of the imaging mass spectrometer according to the present invention is hereinafter described with reference to the attached drawings.

Figure 1:
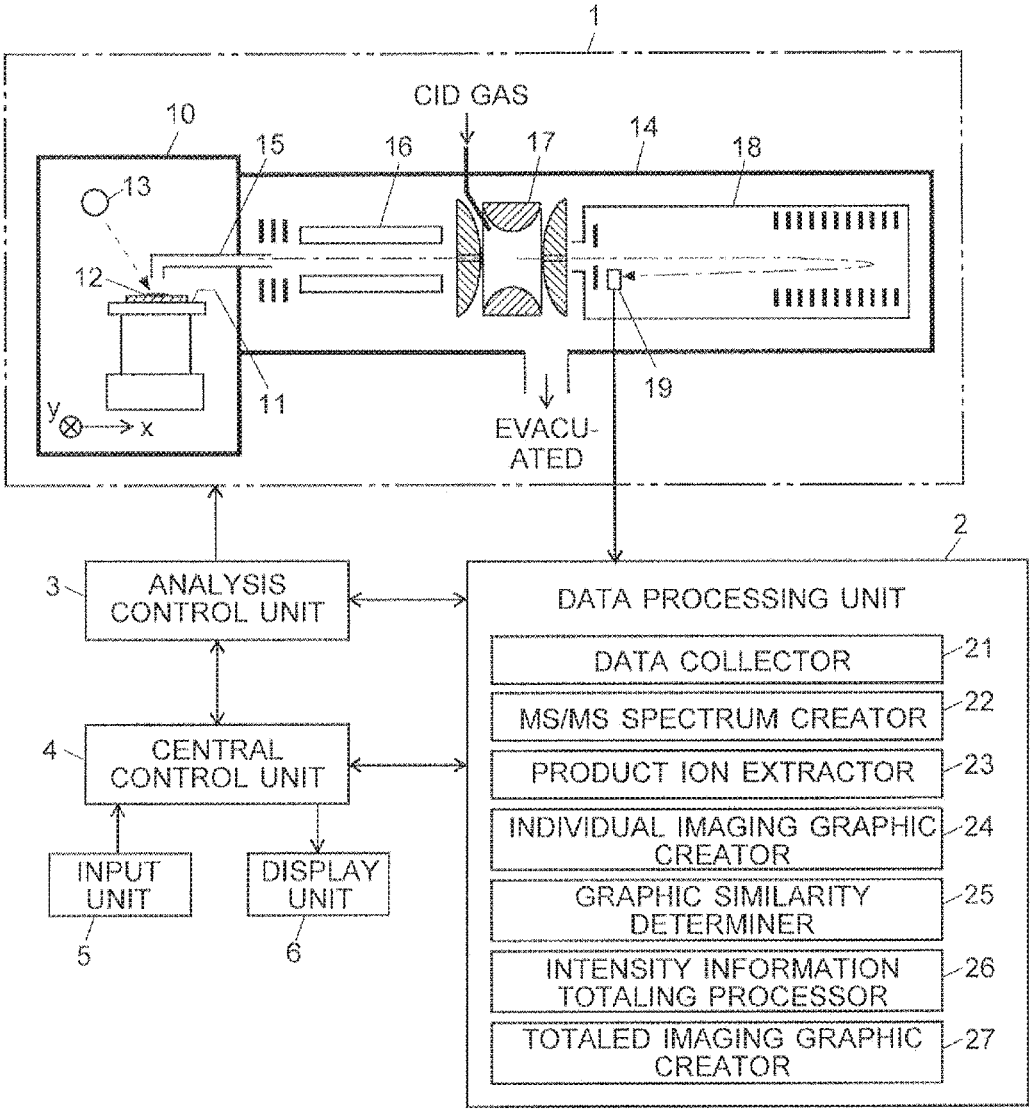
FIG. 1 is a schematic configuration diagram of an imaging mass spectrometer as one embodiment of the present invention.

FIG. 1 is a schematic configuration diagram of the imaging mass spectrometer according to the present embodiment.

The imaging mass spectrometer according to the present embodiment includes: a measurement unit 1 for performing a mass spectrometric analysis for each of a large number of measurement points (micro areas) within a measurement target area on a sample 12, to acquire mass spectrum data for each micro area: a data processing unit 2 for processing a large amount of data acquired by the measurement unit 1: an analysis control unit 3 for controlling the operation of the measurement unit 1; a central control unit 4 for controlling the entire system as well as managing the user interface and other components; and an input unit 5 and a display unit 6 attached to the central control unit 4.

The measurement unit 1 includes the following components arranged within an ionization chamber 10 in which an ambience of atmospheric pressure is maintained: a sample stage 11 which is movable in each of the two directions of x and y axes; a MALDI laser irradiator 13 for irradiating a sample 12 placed on the sample stage 11 with a laser beam of an extremely small diameter to ionize components in the sample 12; an ion introducer 15 for collecting ions generated from the sample 12 and conveying them into a vacuum chamber 14 in which a vacuum atmosphere is maintained; an ion guide 16 for guiding ions derived from the sample 12 while converging them: an ion trap 17 for temporarily capturing ions by a radio-frequency electric field, and for performing the selection of a precursor ion and dissociation of the precursor ion (collision induced dissociation) as needed: a flight tube 18 for internally forming a flight space in which ions ejected from the ion trap 17 are separated from each other according to their mass-to-charge ratios; and a detector 19 for detecting ions. In other words, the measurement unit 1 is an ion trap time-of-flight mass spectrometer capable of an $MS^n$ analysis. Normally, the measurement unit in an imaging mass spectrometer includes an optical microscope for microscopic observation of the sample 12 on the sample stage 11, although this microscope is omitted in the figure.

The data processing unit 2 includes a data collector 21, MS/MS spectrum creator 22, product ion extractor 23, individual imaging graphic creator (which corresponds to the primary graphic creator in the present invention) 24, graphic similarity determiner 25, intensity information totaling processor 26, totaled imaging graphic creator 27 and other functional blocks. The data processing unit 2 as well as the central control unit 4 and the analysis control unit 3 may at least partially be configured using a personal computer (or more sophisticated workstation) including a CPU. RAM, ROM and other components as a hardware resource, with their respective functions realized by executing, on the computer, a dedicated controlling and processing software program previously installed on the same computer.

Figure 2:
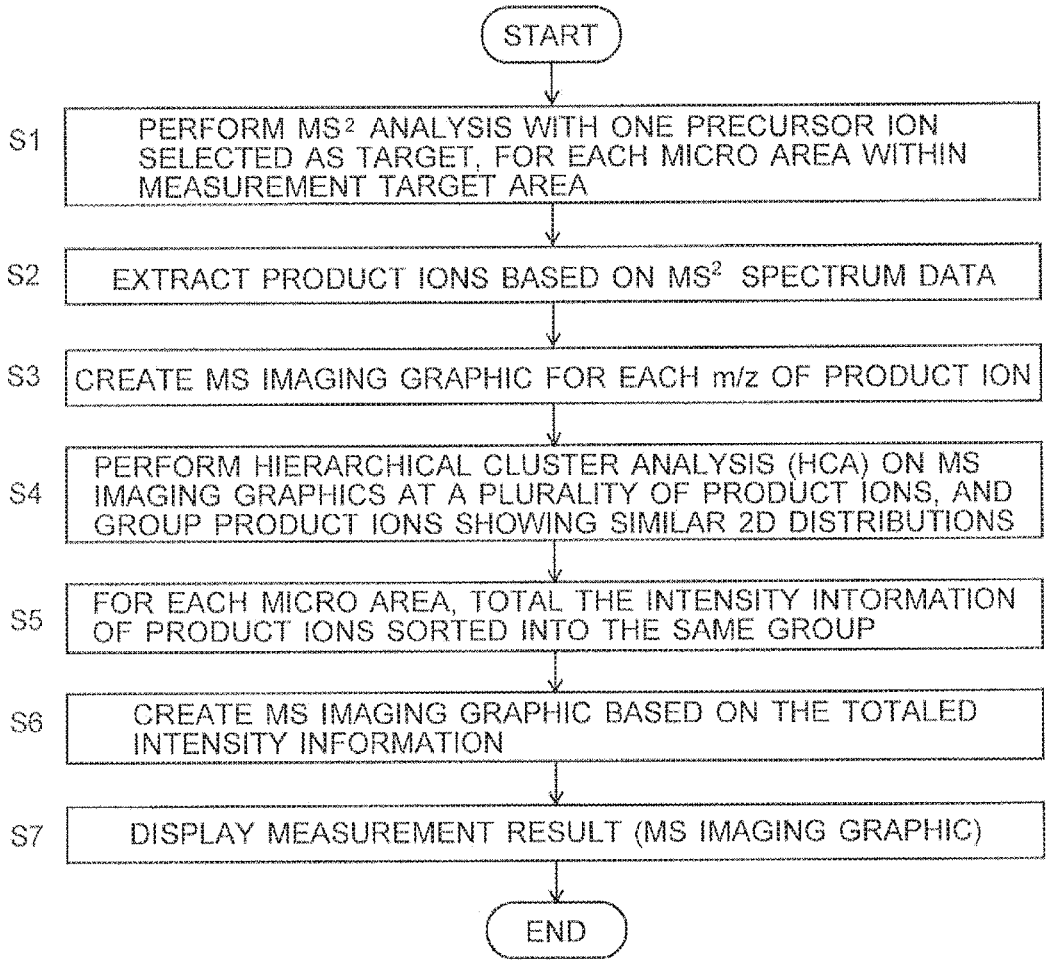
FIG. 2 is a flowchart of a process for creating a mass spectrometric imaging graphic in the imaging mass spectrometer according to the present embodiment.

FIG. 2 is a flowchart of a characteristic process for creating a mass spectrometric imaging graphic in the imaging mass spectrometer according to the present embodiment. FIGS. 3A-3E are model diagrams for explaining the processing operations. Hereinafter, the process for creating a mass spectrometric imaging graphic in the imaging mass spectrometer according to the present embodiment is described with reference to FIGS. 2 and 3A-3E. The following description deals with the case of investigating the state of the two-dimensional distribution of a specific compound contained in the sample 12, such as a biological tissue section.

A specimen for the measurement is placed on a MALDI sample plate. An appropriate kind of matrix is applied to its surface to prepare the sample 12. An analysis operator (user) sets this sample 12 on the sample stage 11 and specifies a measurement target area 121 on the sample 12 with the input unit 5, referring to a microscopic image obtained with the microscope (not shown). The analysis operator also appropriately sets measurement conditions, such as the mass-to-charge ratio of the molecular ion of a specific compound whose two-dimensional distribution needs to be observed. After those tasks, the analysis operator issues a command to execute the measurement. Upon receiving this command via the central control unit 4, the analysis control unit 3 controls the measurement unit 1 so as to perform an $MS^2$ analysis, with the molecular ion of the specific compound as the precursor ion, on each of the micro areas (rectangular areas shown in FIG. 3A) 122 within the specified measurement target area 121.

Specifically, in the measurement unit 1, the sample stage 11 is driven by the drive mechanism (not shown) so that the micro area designated as the first measurement target comes to the laser irradiation point. A pulsed laser beam is delivered from the MALDI laser irradiator 13 onto this micro area, whereupon the compounds in the sample 12 which are present within an area near the irradiated site are ionized. The generated ions are conveyed through the ion introducer 15 into the vacuum chamber 14, where the ions are converged by the ion guide 16 and introduced into the ion trap 17, to be temporarily held by the effect of the radio-frequency electric field.

After the various ions derived from the sample 12 have been held within the ion trap 17, only the specified precursor ion is selectively maintained within the ion trap 17, and CID gas is subsequently introduced into the ion trap 17 to promote dissociation of the precursor ion. Various product ions are generated through the dissociation of the precursor ion. At a predetermined timing, those ions are simultaneously ejected from the ion trap 17 into the flight space inside the flight tube 18. After flying in the flight space, the ions arrive at the detector 19. Those product ions are separated from each other according to their mass-to-charge ratios during their flight, and arrive at the detector 19 in ascending order of mass-to-charge ratio. The detector 19 produces analogue detection signals, which are subsequently converted into digital data by an analogue-to-digital converter (not shown). Those data are sent to the data processing unit 2 and temporarily stored in the data collector 21 as time-of-flight spectrum data.

After the time-of-flight spectrum data for one micro area within the measurement target area 121 has been stored in the data collector 21 in this manner, the sample stage 11 is driven so that the next micro area to be subjected to the measurement comes to the laser irradiation point. Thus, the mass spectrometric analysis ($MS^2$ analysis) is sequentially performed in a predetermined order on all micro areas within the measurement target area 121. After the time-of-flight spectrum data have been obtained for all micro areas, the measurement is discontinued (Step S1).

After the completion of the measurement, or in the middle of the measurement, the MS/MS spectrum creator 22 converts the time of flight in the time-of-flight spectrum data into mass-to-charge ratio to obtain mass spectrum data ($MS^2$ spectrum data) for each micro area. The obtained data are stored in the data collector 21. Consequently, a set of mass spectrum data is obtained for each micro area 122, as shown by an example in FIG. 3B. Subsequently, the product ion extractor 23 extracts the mass-to-charge ratios of the product ions based on the mass spectrum data obtained at all micro areas 122 (Step S2).

Specifically, for example, a mass spectrum is created for each micro area 122 based on the mass spectrum data obtained for that area. Subsequently, peaks are detected on each mass spectrum according to predetermined conditions, and the mass-to-charge ratio of each peak is determined (i.e. the "peak picking" is performed). The collection of the mass-to-charge ratios of all peaks determined in this manner can be considered as the mass-to-charge ratios of the product ions. Needless to say, additional processing may be performed in the detection of the peaks from each mass spectrum, such as the removal of the noise peaks, setting of the lower limit of the signal intensity, or limiting the number of peaks to be detected. A plurality of product ions whose mass-to-charge-ratio values do not exactly coincide with each other may be considered as practically one product ion and merged with each other if their mass-to-charge-ratio values fall within a predetermined range which is set to allow for the mass-resolving power.

Figures 3A, 3B, 3C, 3D, 3E:
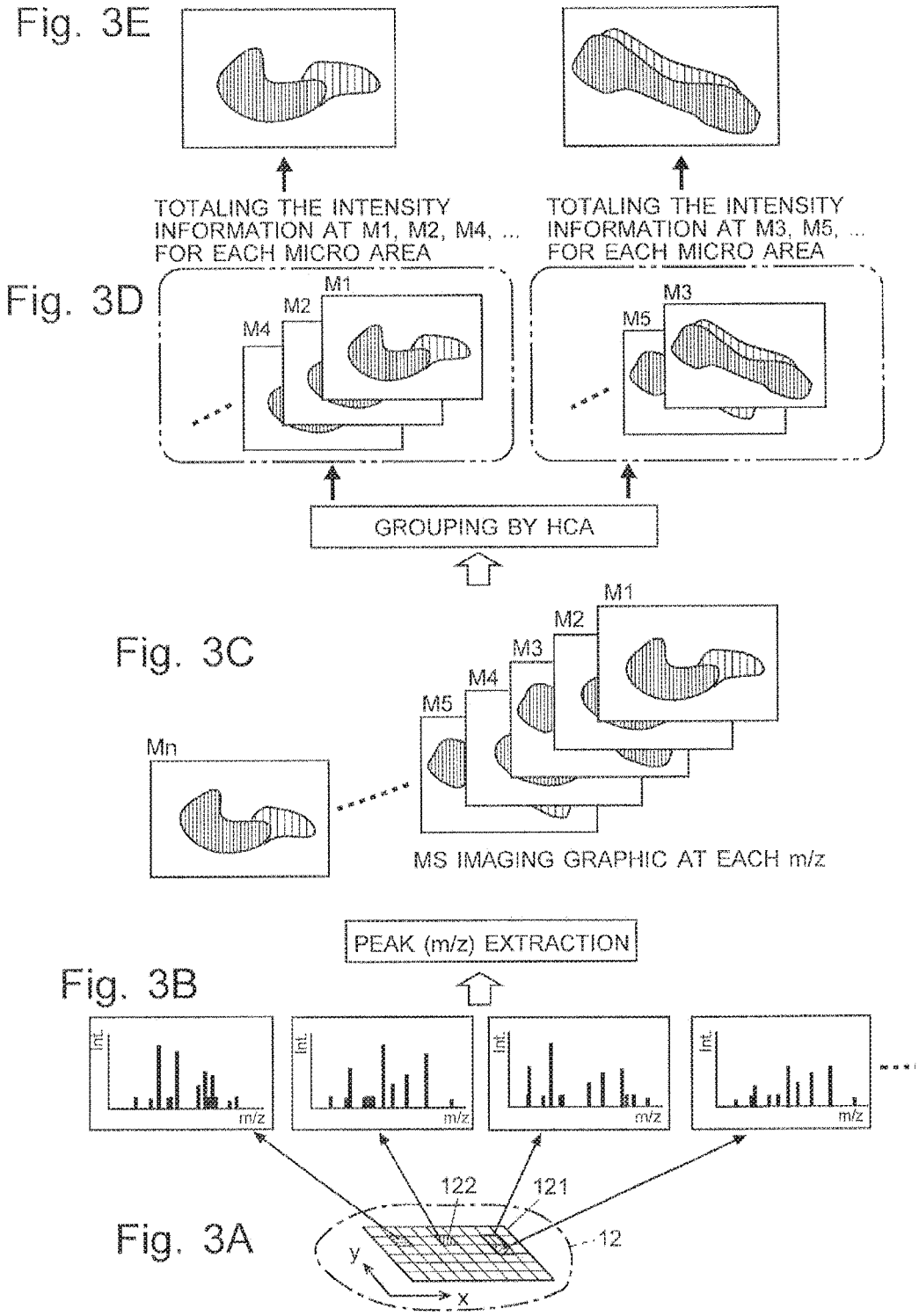
FIGS. 3A-3E are model diagrams for explaining the process for creating a mass spectrometric imaging graphic in the imaging mass spectrometer according to the present embodiment.

A large number of product ions originating from one precursor ion are extracted by the process of Step S2. It is naturally possible that they include noise peaks or other peaks which actually are not product ions. Subsequently, the individual imaging graphic creator 24 extracts intensity information at the mass-to-charge ratio of each product ion from the $MS^2$ spectrum data for each micro area 122, and creates a mass spectrometric imaging graphic for each of the mass-to-charge ratios of the product ions, the graphic showing the relationship between the two-dimensional position information of the micro area and the intensity information (Step S3). Thus, as shown in FIG. 3C, mass spectrometric imaging graphics are created for a plurality of product ions originating from one precursor ion (or ions which are supposed to be product ions). M1, M2, . . . Mn in FIG. 3C are the mass-to-charge ratios of the product ions.

The precursor ion which was set in the measurement in Step S1 may not be an ion originating from one compound; it may actually be a plurality of ions originating from multiple compounds and overlapping each other due to their mass-to-charge ratios being identical or extremely close to each other. In such a case, the product ions may possibly be a mixture of product ions originating from compounds which are different from each other. Product ions originating from the same compound should have approximately the same two-dimensional distribution, whereas product ions originating from different compounds are most likely to have different two-dimensional distributions. Accordingly, the graphic similarity determiner determines the similarity of the mass spectrometric imaging graphics of the product ions, for example, by applying hierarchical cluster analysis (HCA) to those mass spectrometric imaging graphics. Then, the graphic similarity determiner 25 groups the product ions in such a manner that product ions whose two-dimensional distributions on the obtained mass spectrometric imaging graphics are highly similar to each other belong to the same group (Step S4). It should be noted that any technique, such as the supervised clustering, may be used in place of the hierarchical cluster analysis to determine the similarity of the graphics, or two-dimensional intensity distributions.

In the example of FIG. 3D, the product ions with mass-to-charge ratios M1, M2, M4, . . . are sorted into one group based on the result of the determination of the similarity of the graphics, while the product ions with mass-to-charge ratios M3, M5, . . . are sorted into another group. Noise peaks normally form a group including a single member that does not belong to any other group. This group can be separated from the groups of the product ions.

Due to the above-described reason, it is possible to consider that a plurality of product ions sorted into the same group have originated from one compound. Accordingly, the intensity information totaling processor 26 totals the intensity information of the sorted product ions in each group and for each micro area. In other words, the processor totals, for each micro area, the intensity information of a plurality of product ions which are likely to have originated from the same compound (Step S5). In the example of FIGS. 3A-3E, the intensity information of the product ions with mass-to-charge ratios M1, M2, M4, . . . in the $MS^2$ spectrum data is totaled for each micro area on the one hand, while the intensity information of the product ions with mass-to-charge ratios M3, M5, . . . in the $MS^2$ spectrum data is totaled for each micro area on the other hand.

Subsequently, the totaled imaging graphic creator 27 creates a mass spectrometric imaging graphic for each group, based on the intensity information obtained by the totaling process for each micro area, as shown in FIG. 3E (Step S6). The mass spectrometric imaging graphic created in this step is not a graphic based on the intensity information at a single mass-to-charge ratio on the $MS^2$ spectrum, but a graphic based on the intensity information at a plurality of mass-to-charge ratios. In Step S5, only the mass-to-charge ratios which have highly similar two-dimensional distributions on the mass spectrometric imaging graphics are subjected to the totaling process. This totaling process increases the intensity information at each micro area where the compound which is the origin of the product ions having those mass-to-charge ratios is present. Therefore, the mass spectrometric imaging graphic created in Step S6 has a higher SN ratio, higher sensitivity and wider dynamic range than a mass spectrometric imaging graphic created for a single mass-to-charge ratio. The totaled imaging graphic creator 27 displays the mass spectrometric imaging graphic created for each group on the display unit 6 via the central control unit 4 (Step S7).

As long as no two or more compounds contained in the sample have the same two-dimensional distribution, it is possible to infer that one group which includes a plurality of product ions corresponds to one compound. Therefore, in many cases, if one precursor ion which has been set has two overlapping compounds, two groups will be created, exclusive of the noise peaks, and one mass spectrometric imaging graphic is created for each group. The two mass spectrometric imaging graphics show the two-dimensional distributions of the two overlapping compounds, respectively, one of which is the specific compound that the analysis operator has intended to observe. The other is a different compound.

Naturally, not only the eventually obtained mass spectrometric imaging graphic, but those created in Step S3 may also be displayed on the screen of the display unit 6 as needed.

In the previously described embodiment, the product ion extractor 23 automatically extracts product ions from $MS^2$ spectrum data. If the analysis operator previously knows the mass-to-charge ratios of some of the product ions originating from the specific compound that needs to be observed, the mass-to-charge ratios of those product ions can be previously entered from the input unit 5 as a part of the measurement conditions. In this case, only the group which includes the entered mass-to-charge ratios of the product ions may be selected for the totaling of the intensity information in Step S5, and the mass spectrometric imaging graphic may be created for only that single group.

Figure 4:
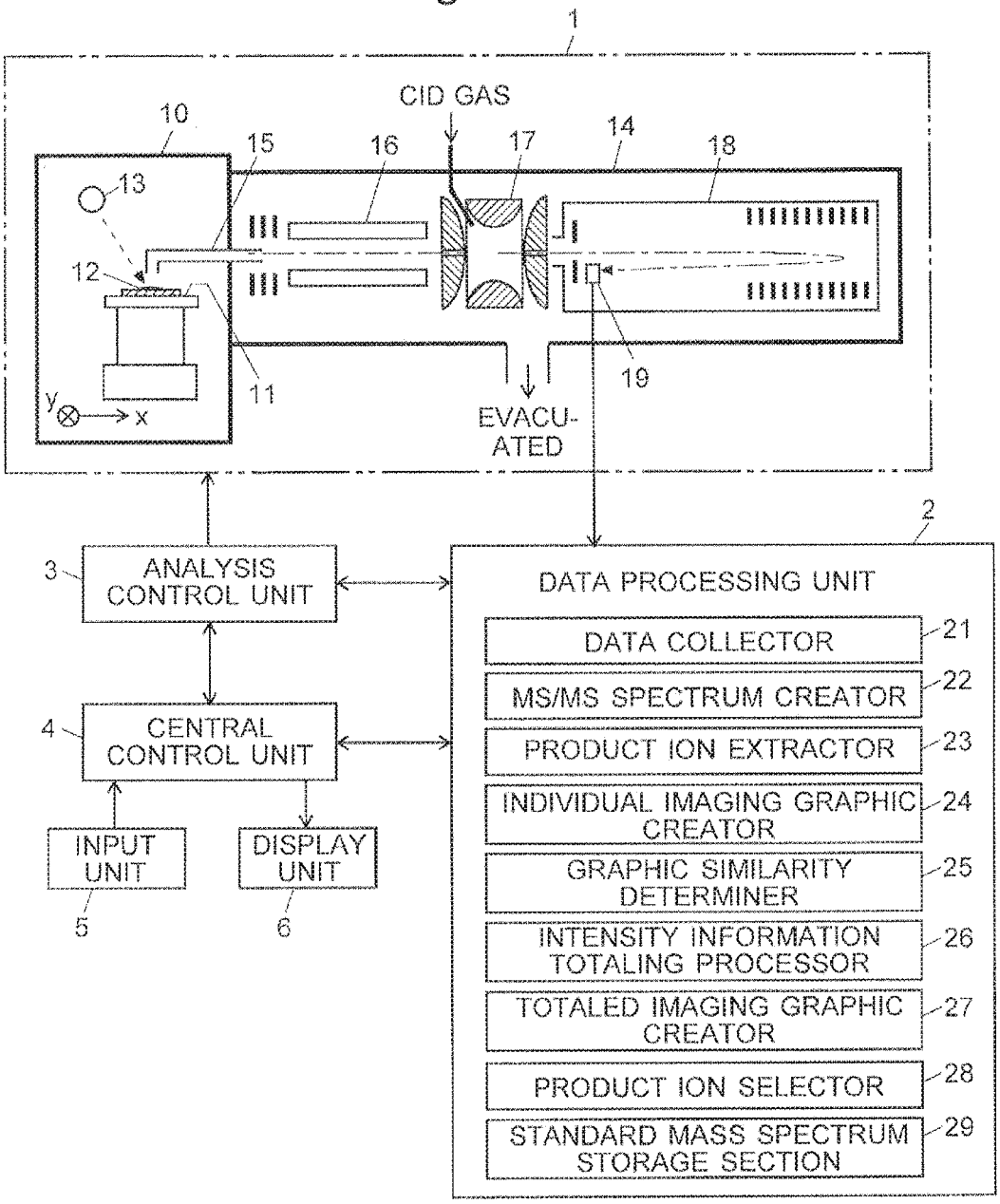
FIG. 4 is a schematic configuration diagram of an imaging mass spectrometer as another embodiment of the present invention.

In the case where only the mass spectrometric imaging graphic which shows the two-dimensional distribution of a specific compound needs to be obtained, the configuration according to the second embodiment which is hereinafter described may be adopted. FIG. 4 is a schematic configuration diagram of an imaging mass spectrometer according to the second embodiment. The same components as already shown in FIG. 1 are denoted by the same reference signs. Detailed descriptions of those components will be omitted.

In the imaging mass spectrometer according to the second embodiment, the data processing unit 2 additionally includes a product ion selector 28 and a standard mass spectrum storage section 29. The standard mass spectrum storage section 29 is a type of database in which $MS^2$ spectra obtained by performing an $MS^2$ analysis on reference standards of various compounds are previously stored and associated with compound names. Each of those stored $MS^2$ spectra may be replaced by a list which shows the mass-to-charge ratios of the product ions obtained by performing a peak detection on the $MS^2$ spectrum concerned.

The operation of the present imaging mass spectrometer is basically the same as that of the imaging mass spectrometer according to the previous embodiment. A difference is as follows:

In advance of the measurement, the analysis operator using the input unit 5 sets the name of a specific compound whose two-dimensional distribution needs to be observed as one of the measurement conditions. The product ion selector 28 reads the $MS^2$ spectrum corresponding to the set compound from the standard mass spectrum storage section 29 and designates it as the standard mass spectrum.

In Step S2, the product ion extractor 23 extracts the mass-to-charge ratios of a plurality of product ions based on $MS^2$ spectrum data. Subsequently, the product ion selector 28 determines whether or not the extracted mass-to-charge ratios of the product ions are also present on the standard mass spectrum, and excludes mass-to-charge ratios which are not present on the standard mass spectrum, judging that those mass-to-charge ratios have no relation with the product ions derived from the specific compound. The product ions which are eventually left after such a process, i.e. the product ions whose mass-to-charge ratios are observed on the standard mass spectrum, are selected for the process in the next step S3.

Even if there is a different compound having a similar two-dimensional distribution to the specific compound, the influence of such a compound can be eliminated by the addition of such a product-ion selection process, and a mass spectrometric imaging graphic which corresponds to only the specific compound can be created.

It is also possible to designate, as the standard mass spectrum, an $MS^2$ spectrum corresponding to a compound whose presence has been confirmed from the result of a measurement of a certain sample, instead of designating, as the standard mass spectrum, an $MS^2$ spectrum corresponding to a compound specified by an analysis operator in advance of a measurement. That is to say, an $MS^2$ spectrum obtained by a measurement of a certain sample is compared with the $MS^2$ spectra in the database stored in the standard mass spectrum storage section 29, to infer (or identify) the compound species with a highly similar spectrum pattern. The $MS^2$ spectrum of the inferred compound species is designated as the standard mass spectrum, and a mass spectrometric imaging graphic which shows the two-dimensional distribution of that compound species in a certain sample is created. By this method, a mass spectrometric imaging graphic showing the two-dimensional distribution in a sample can be created for a target compound whose compound species is unknown.

It should be noted that the previously described embodiments are mere examples of the present invention, and any change, modification or addition appropriately made within the spirit of the present invention will naturally fall within the scope of claims of the present application.

REFERENCE SIGNS LIST

1 . . . Measurement Unit
10 . . . Ionization Chamber
11 . . . Sample Stage
12 . . . Sample
121 . . . Measurement Target Area
122 . . . Micro Area
13 . . . MALDI Laser Irradiator
14 . . . Vacuum Chamber
15 . . . Ion Introducer
16 . . . Ion Guide
17 . . . Ion Trap
18 . . . Flight Tube
19 . . . Detector
2 . . . Data Processing Unit
21 . . . Data Collector
22 . . . MS/MS Spectrum Creator
23 . . . Product Ion Extractor
24 . . . Individual Imaging Graphic Creator
25 . . . Graphic Similarity Determiner
26 . . . Intensity Information Totaling Processor
27 . . . Totaled Imaging Graphic Creator
28 . . . Product Ion Selector
29 . . . Standard mass spectrum Storage Section
3 . . . Analysis Control Unit
4 . . . Central Control Unit
5 . . . Input Unit
6 . . . Display Unit

The invention claimed is:

1. An imaging mass spectrometer for creating a graphic reflecting a distribution of a substance within a two-dimensional area on a sample, based on data collected by performing an $MS^n$ analysis on each of a plurality of micro areas set within the two-dimensional area (where n is an integer equal to or greater than two), the imaging mass spectrometer comprising:

a detector, an ion guide configured to pass ions from the sample to the detector; and at least one processor, including a) a distribution similarity determiner for determining a similarity in two-dimensional intensity distribution of a plurality of obtained product ions, based on data obtained by the detector in an $MS^n$ analysis for a same precursor ion on each micro area, and for grouping together product ions having a high degree of similarity in two-dimensional intensity distribution;

b) an intensity information calculator for totaling or averaging, for each micro area, intensity information of a plurality of product ions sorted into one group by the distribution similarity determiner, to calculate intensity information due to the plurality of product ions in each micro area; and a graphic creator for creating a mass spectrometric imaging graphic based on the intensity information due to the plurality of product ions in each micro area obtained by the intensity information calculator.

2. The imaging mass spectrometer according to claim 1, wherein:

the distribution similarity determiner determines the similarity in two-dimensional distribution of a plurality of product ions by hierarchical cluster analysis.

3. The imaging mass spectrometer according to claim 1, wherein the at least one processor further comprises:

a product ion extractor for extracting a mass-to-charge ratio of a product ion based on data obtained by an $MS^n$ analysis for the same precursor ion in each micro area.

4. The imaging mass spectrometer according to claim 3, wherein:

the product ion extractor selects a product ion with reference to a given standard mass spectrum.

5. The imaging mass spectrometer according to claim 2 wherein the at least one processor further comprises:

a product ion extractor for extracting a mass-to-charge ratio of a product ion based on data obtained by an $MS^n$ analysis for the same precursor ion n each micro area.

* * * * *